US011823703B2

(12) United States Patent
Schreibman

(10) Patent No.: US 11,823,703 B2
(45) Date of Patent: Nov. 21, 2023

(54) SYSTEM AND METHOD FOR PROCESSING AN AUDIO INPUT SIGNAL

(71) Applicant: GM GLOBAL TECHNOLOGY OPERATIONS LLC, Detroit, MI (US)

(72) Inventor: Amos Schreibman, Hod Hasharon (IL)

(73) Assignee: GM Global Technology Operations LLC, Detroit, MI (US)

( * ) Notice: Subject to any disclaimer, the term of this patent is extended or adjusted under 35 U.S.C. 154(b) by 25 days.

(21) Appl. No.: 17/591,696

(22) Filed: Feb. 3, 2022

(65) Prior Publication Data

US 2023/0245673 A1 Aug. 3, 2023

(51) Int. Cl.

| | |
|---|---|
| ***G10L 25/30*** | (2013.01) |
| ***G10L 21/0264*** | (2013.01) |
| ***G10L 19/12*** | (2013.01) |
| ***G10L 25/06*** | (2013.01) |
| ***G10L 21/0216*** | (2013.01) |

(52) U.S. Cl.

CPC ..... *G10L 25/30* (2013.01); *G10L 19/12* (2013.01); *G10L 21/0264* (2013.01); *G10L 25/06* (2013.01); *G10L 2021/02163* (2013.01)

(58) Field of Classification Search

CPC ..... G10L 25/30; G10L 19/12; G10L 21/0264; G10L 25/06; G10L 2021/02163

See application file for complete search history.

(56) References Cited

U.S. PATENT DOCUMENTS 5,742,694 A * 4/1998 Eatwell ..... H04B 1/123 381/94.2
2006/0259261 A1* 11/2006 Murabayashi ..... H04N 5/76 702/104
2018/0233127 A1* 8/2018 Visser ..... G10L 13/047

FOREIGN PATENT DOCUMENTS

CN 108540338 A * 9/2018 ..... G06N 3/0454
CN WO 2023044962 A1 * 3/2023 ..... G10L 25/30

* cited by examiner

*Primary Examiner* — Daniel C Washburn
*Assistant Examiner* — Paul J. Mueller
(74) *Attorney, Agent, or Firm* — Quinn IP Law

(57) ABSTRACT

A system and method for processing an audio input signal includes a microphone, a controller, and a communication link that may be coupled to a remote speaker. The microphone captures the audio input signal and communicates the audio input signal to the controller, and the controller is coupled to the communication link. The controller includes executable code to generate, via a linear noise reduction filtering algorithm, a first resultant based upon the audio input signal, and generate, via non-linear post filtering algorithm, a second resultant based upon the first resultant. An audio output signal is generated based upon the second resultant employing a feature restoration algorithm. The audio output signal is communicated, via the communication link, to a speaker that may be at a remote location.

20 Claims, 2 Drawing Sheets

SYSTEM AND METHOD FOR PROCESSING AN AUDIO INPUT SIGNAL

INTRODUCTION

Speech processing systems include the use of hands-free, speakerphone-like systems, such as smart phones, videoconferencing systems, laptops and tablets. In some systems, the speaker may be located in an enclosed room and at a relatively large distance away from a microphone. Such arrangements may introduce environmental noise, including ambient noise, interferences, and reverberations. Such arrangements may result in acoustic signal processing challenges that affect sound quality and an associated signal-to-noise ratio (SNR).

Speech processing technologies such as automatic speech recognition (ASR) and teleconferencing often incorporate noise reduction strategies and systems to reduce the audible ambient noise level and improve speech intelligibility. Noise reduction systems may include linear noise reduction algorithms, non-linear post filtering algorithms, etc. Performance of linear noise reduction algorithms may not be sufficient to achieve a desired signal-to-noise (SNR) target. A non-linear post filtering algorithm (PF) arranged in series with a linear noise reduction algorithm may enhance noise reduction levels, but there are trade-offs between residual noise and speech distortion levels. Sound distortion may be caused by the removal of speech features from the signal due to spectral subtraction algorithms that may be employed in a PF module. Such a system requires precise tuning to reach a target SNR with minimal speech distortion, which may be difficult to achieve.

As such, there is a need for an improved method and system for speech processing that includes noise reduction strategies that reduce audible ambient noise levels, improve speech intelligibility, and reduce a need for precise tuning.

SUMMARY

The concepts described herein provide for methods, apparatuses, and systems for speech processing that include noise reduction strategies to reduce audible ambient noise levels and improve speech intelligibility.

The concepts include a system for processing an audio input signal employing a microphone, a controller, and a communication link that may be coupled to a remotely located speaker. The microphone is configured to capture and generate the audio input signal and communicate the audio input signal to the controller, and the controller is coupled to the communication link. The controller includes executable code to generate, via a linear noise reduction filtering algorithm, a first resultant based upon the audio input signal, and generate, via non-linear post filtering algorithm, a second resultant based upon the first resultant. An audio output signal is generated based upon the second resultant employing a feature restoration algorithm. The audio output signal is communicated, via the communication link, to a speaker that may be at a remote location.

An aspect of the disclosure includes the feature restoration algorithm being a deep neural network (DNN)-based module including: a STFT (Short-time Fourier transform) layer; a plurality of convolutional layers; a first LSTM (long short-term memory) layer; a second LSTM layer; a dense layer; a plurality of transposed convolutional layers; and an ISTFT (Inverse-Short-time Fourier transform) layer.

Another aspect of the disclosure includes the STFT transforming the audio input signal from an amplitude domain to a frequency domain.

Another aspect of the disclosure includes the STFT transforming the audio input signal to the frequency domain as a 2 channel sequence having a real portion and an imaginary portion.

Another aspect of the disclosure includes the plurality of convolutional layers being a first convolutional layer having a 2 channel input with 256 features and a 32 channel output with 128 features; a second convolutional layer having a 32 channel input with 128 features and a 64 channel output with 64 features; a third convolutional layer having a 64 channel input with 64 features and a 128 channel output with 32 features; a fourth convolutional layer having a 128 channel input with 32 features and a 128 channel output with 16 features; a fifth convolutional layer having a 128 channel input with 16 features and a 256 channel output with 8 features; and a sixth convolutional layer having a 256 channel input with 8 features and a 256 channel output with 4 features.

Another aspect of the disclosure includes the 256 channel output with 4 features that is output from the sixth convolutional layer being provided as an input to the first LSTM layer.

Another aspect of the disclosure includes each of the plurality of convolutional layers having a kernel of size (2, 9) and stride of size (1, 2).

Another aspect of the disclosure includes an input of the first convolutional layer being provided as an input to the ISTFT.

Another aspect of the disclosure includes the output of the sixth convolutional layer being provided as input to the first LSTM layer.

Another aspect of the disclosure includes the first LSTM layer having 256 states.

Another aspect of the disclosure includes the second LSTM layer having 256 states.

Another aspect of the disclosure includes the output of the second LSTM layer being provided as input to a dense layer.

Another aspect of the disclosure includes the plurality of transposed convolutional layers having a sixth transposed convolutional layer having a 512 channel input with 4 features and 256 channel output with 8 features; a fifth transposed convolutional layer having a 512 channel input with 8 features and a 128 channel output with 16 features; a fourth transposed convolutional layer having a 256 channel input with 16 features and a 128 channel output with 32 features; a third transposed convolutional layer with a 256 channel input with 32 features and 64 channel output with 64 features; a second transposed convolutional layer with 128 channel input with 64 features and a 32 channel output with 128 features; and a first transposed convolutional layer with 64 channel input with 128 features and 2 channel output with 256 features.

Another aspect of the disclosure includes the output of the dense layer being provided as input to the sixth transposed convolutional layer.

Another aspect of the disclosure includes each of the plurality of transposed convolutional layers having kernel of size (2, 9) and stride of size (1, 2).

Another aspect of the disclosure includes the output of the first transposed convolutional layer being provided as an input to the ISTFT to effect feature restoration.

Another aspect of the disclosure includes the output of the first convolutional layer being provided as an input to the first transposed convolutional layer.

Another aspect of the disclosure includes the output of the second convolutional layer being provided as an input to the second transposed convolutional layer.

Another aspect of the disclosure includes the output of the third convolutional layer being provided as an input to the third transposed convolutional layer.

Another aspect of the disclosure includes the output of the fourth convolutional layer being provided as an input to the fourth transposed convolutional layer.

Another aspect of the disclosure includes the output of the fifth convolutional layer being provided as an input to the fifth transposed convolutional layer.

Another aspect of the disclosure includes the output of the sixth convolutional layer being provided as an input to the sixth transposed convolutional layer.

Another aspect of the disclosure includes the ISTFT transforming the transposed audio input signal combined with the output of the first transposed convolutional layer from a frequency domain to an amplitude domain to generate the audio output signal.

Another aspect of the disclosure includes a method for processing an audio input signal that includes capturing, via a microphone, an audio input signal; subjecting the audio input signal to a linear noise reduction filtering algorithm to generate a first resultant; subjecting the first resultant to a non-linear post filtering algorithm to generate a second resultant; generating an audio output signal by subjecting the second resultant to a feature restoration algorithm; and controlling a speaker responsive to the audio output signal.

Another aspect of the disclosure includes a system for processing a speech input, including a microphone, a controller, and a speaker, wherein the microphone is configured to capture a speech input signal and communicate the speech input signal to the controller; and wherein the controller is operatively connected to the speaker. The controller includes executable code to subject the speech input signal to a linear noise reduction filtering algorithm to generate a first resultant; subject the first resultant to a non-linear post filtering algorithm to generate a second resultant; generate an audio output signal by subjecting the second resultant to a feature restoration algorithm; and control the speaker responsive to the speech output signal.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

BRIEF DESCRIPTION OF THE DRAWINGS

One or more embodiments will now be described, by way of example, with reference to the accompanying drawings, in which.

Figure 1:
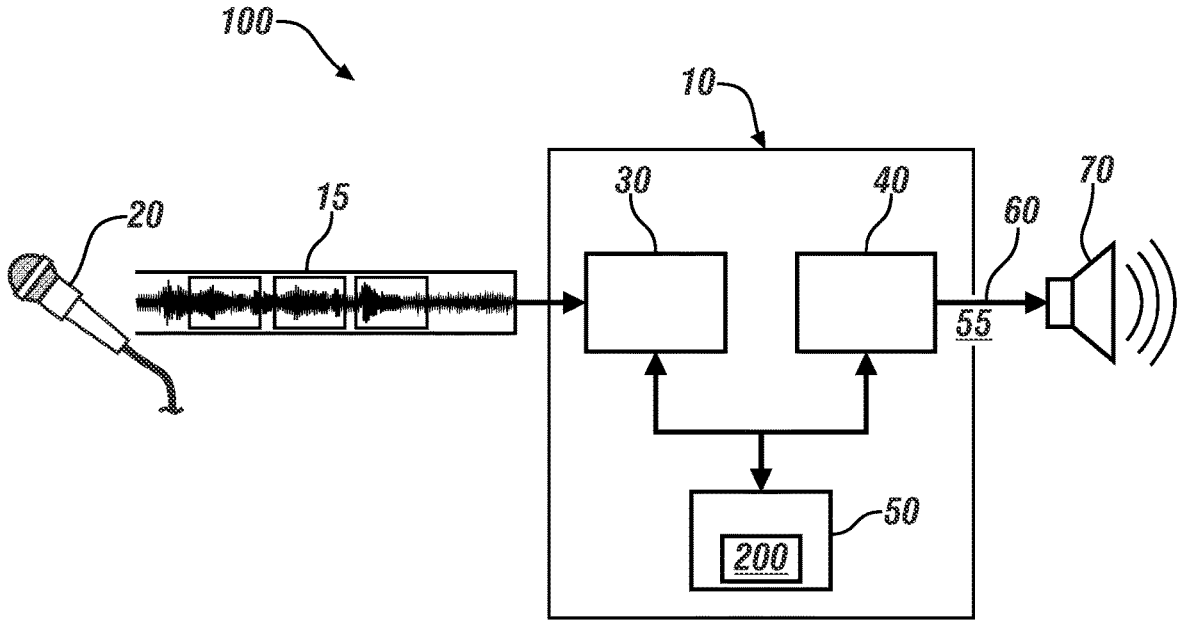
FIG. 1 schematically illustrates a microphone, a controller, and a communication link that may be coupled to a remote speaker, in accordance with the disclosure.

The appended drawings are not necessarily to scale, and may present a somewhat simplified representation of various preferred elements of the present disclosure as disclosed herein, including, for example, specific dimensions, orientations, locations, and shapes. Details associated with such elements will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Throughout the drawings, corresponding reference numerals indicate like or corresponding parts and elements. Furthermore, the disclosure, as illustrated and described herein, may be practiced in the absence of an element that is not specifically disclosed herein. Furthermore, there is no intention to be bound by any expressed or implied theory presented herein.

As used herein, the term "system" may refer to one of or a combination of mechanical and electrical actuators, sensors, controllers, application-specific integrated circuits (ASIC), combinatorial logic circuits, software, firmware, and/or other components that are arranged to provide the described functionality. Embodiments may be described herein in terms of functional and/or logical block components and various processing steps. It should be appreciated that such block components may be realized by any quantity, combination or collection of mechanical and electrical hardware, software, and/or firmware components configured to perform the specified functions and/or routines. For the sake of brevity, conventional components and techniques and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may instead be present.

The use of ordinals such as first, second and third does not necessarily imply a ranked sense of order, but rather may distinguish between multiple instances of an act or structure.

Referring now to the drawings, which are provided for the purpose of illustrating certain exemplary embodiments and not for the purpose of limiting the same, FIG. 1 schematically illustrates a system 100 including a microphone 20 and a controller 10 that is capable of communicating via a communication link 60 with a remotely-located audio speaker 70. In one embodiment, the remotely-located audio speaker 70 is at a location external to the system 100. The system 100 includes a noise reduction routine 200 for managing an audio input signal 15 to reduce audible ambient noise levels and improve speech intelligibility. The term "speech intelligibility" refers to speech clarity, i.e., the degree to which speech sounds may be correctly identified and understood by a listener.

The microphone 20 may be any device that includes a transducer capable of converting audible sound into an electrical signal in the form of an audio input signal 15. The communication link 60 may be a direct wired point-to-point link, a networked communication bus link, a wireless link, or another communication link.

The controller 10 includes a receiver 30, a processor 40, and memory 50, wherein the memory 50 includes an embodiment of the noise reduction routine 200 and provides data storage.

The term "controller" and related terms refer to one or various combinations of Application Specific Integrated Circuit(s) (ASIC), Field-Programmable Gate Array(s) (FPGA), electronic circuit(s), central processing unit(s), e.g., microprocessor(s) and associated transitory and non-transitory memory component(s) in the form of memory and data storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning, buffer circuitry and other components, which can be accessed by and executed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms, and similar terms mean controller-executable instruction sets including calibrations and look-up tables. Each controller executes control routine(s) to provide desired functions. Routines may be executed at regular intervals, for example every 100 microseconds during ongoing operation. Alternatively, routines may be executed in response to occurrence of a triggering event. Communication between controllers, actuators and/or sensors, and the remotely-located audio speaker 70 may be accomplished using a direct wired point-to-point link, a networked communication bus link, a wireless link, or another communication link. Communication includes exchanging data signals, including, for example, electrical signals via a conductive medium; electromagnetic signals via air; optical signals via optical waveguides; etc. The data signals may include discrete, analog and/or digitized analog signals representing inputs from sensors, actuator commands, and communication between controllers.

The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

Figure 2:
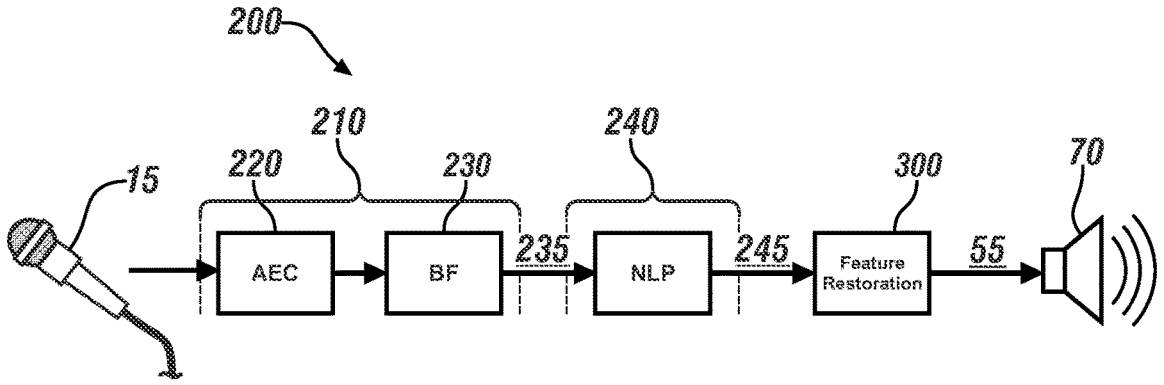
FIG. 2 schematically illustrates elements of a noise reduction routine for processing an audio input signal, in accordance with the disclosure.

FIG. 2 schematically illustrates elements of the noise reduction routine 200 for processing the audio input signal 15, including a linear noise reduction algorithm 210, a non-linear post filter algorithm 240, and a feature restoration algorithm 300.

The linear noise reduction algorithm 210 includes acoustic echo cancellation (AEC) 220 and beam forming (BF) 230. AEC 220 is a digital signal processing technique for identifying and cancelling acoustic echoes that is reduced to practice as an algorithm. BF 230 is a digital signal processing technique that uses spatial information to reduce the ambient noise power, thus improving the power ratio between the desired signal and noise. In one embodiment, and as shown, the AEC 220 precedes the BF 230. Alternatively, the BF 230 may precede the AEC 220. Acoustic echo cancellation and beam forming are acoustic signal processing techniques that are known to skilled practitioners.

The linear noise reduction algorithm 210 generates a first resultant signal 235, which is provided as input to the non-linear post filter (NLP) algorithm 240. The NLP algorithm 240 enhances the noise reduction level by employing non-linear filtering to reduce the residual noise and echoes. NLP is an acoustic signal processing technique that is known to skilled practitioners.

The NLP algorithm 240 generates a second resultant signal 245, which is provided as input to the feature restoration algorithm 300. The feature restoration algorithm 300 generates the audio output signal 55 based upon the second resultant signal 245. The DNN-based feature restoration algorithm 300 is placed after the post-filtering module to simplify tuning and improve the speech quality.

Figure 3:
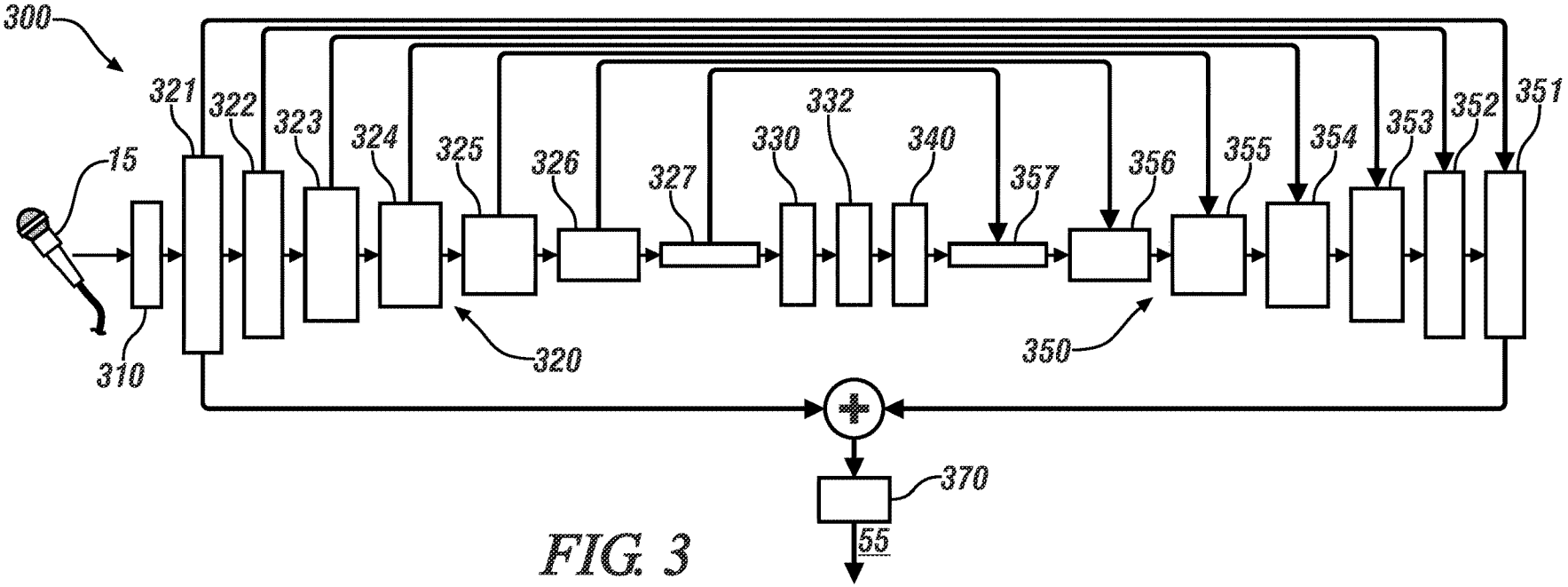
FIG. 3 schematically illustrates elements of a feature restoration algorithm including a deep neural network (DNN) module for processing an audio input signal as part of a noise reduction routine, in accordance with the disclosure.

FIG. 3 schematically illustrates elements of the feature restoration algorithm 300 for processing the audio input signal 15 as part of the noise reduction routine 200. The feature restoration algorithm 300 is composed as a deep neural network (DNN) module that includes a Short-time Fourier transform (STFT) layer 310, a plurality of convolutional layers 320, a first long short-term memory (LSTM) layer 330, a second LSTM layer 332, a dense layer 340, a plurality of transposed convolutional layers 350, and an ISTFT layer 370.

The STFT and ISTFT layers 310, 370 are each a sequence of Fourier transforms of a windowed signal that provides time-localized frequency information for situations in which frequency components of a signal vary over time. An RNN (Recurrent Neural Network) is a time series version of an artificial neural network or ANN that is arranged to process sequences of data, such as sound. An RNN-based DNN utilizes strong correlations between speech time and frequency in speech processing for noise reduction and blind source separation. This ability can be harnessed to the restoration problem, which results in a simplified tuning of the Post Filter module, at lower ambient noise levels to achieve improved speech quality in the form of speech intelligibility.

The first and second Long Short-Term Memory (LSTM) layers 330, 332 are a type of recurrent neural network commonly used for tasks such as text-to-speech or natural language processing. They have a recurrent state which is updated each time new data is fed through the network. In this way, the LSTM layers have a memory.

The STFT layer 310 transforms the audio input signal 15 from an amplitude domain to a frequency domain in the form of a 2 channel sequence having a real portion and an imaginary portion.

In one embodiment, the plurality of convolutional layers 320 includes a first convolutional layer 321 having a 2 channel input with 256 features and a 32 channel output with 128 features; a second convolutional layer 322 having a 32 channel input with 128 features and a 64 channel output with 64 features; a third convolutional layer 323 having a 64 channel input with 64 features and a 128 channel output with 32 features; a fourth convolutional layer 324 having a 128 channel input with 32 features and a 128 channel output with 16 features; a fifth convolutional layer 325 having a 128 channel input with 16 features and a 256 channel output with 8 features; and a sixth convolutional layer 326 having a 256 channel input with 8 features and a 256 channel output with 4 features.

Each of the plurality of convolutional layers 320 has kernel of size (2, 9) and stride of size (1, 2), in one embodiment. The kernel is a filter that is used to extract the features from the data, and is a matrix that moves over the input data, performs a dot product with a sub-region of input data, and has an output as the matrix of dot products. The stride controls how the filter convolves around the input volume.

The 256 channel output with 4 features (327) that is output from the sixth convolutional layer 326 is provided as an input to the first LSTM layer 330, which has 256 states.

An input of the first convolutional layer 321 is provided as an input to the ISTFT layer 370.

An output of the first LSTM layer 330 is provided as input to the second LSTM layer 332, and an output of the second LSTM layer 332 is provided as input to dense layer 340.

An output of the dense layer 340 is provided as input (357) to the plurality of transposed convolutional layers 350, specifically to a sixth convolutional layer 326.

The plurality of transposed convolutional layers 350 includes a sixth transposed convolutional layer 356 having a 512 channel input with 4 features and 256 channel output with 8 features; a fifth transposed convolutional layer 355 having a 512 channel input with 8 features and a 128 channel output with 16 features; a fourth transposed convolutional layer 354 having a 256 channel input with 16 features and a 128 channel output with 32 features; a third transposed convolutional layer 353 with a 256 channel input with 32 features and 64 channel output with 64 features; a second transposed convolutional layer 352 with 128 channel input with 64 features and a 32 channel output with 128 features; and a first transposed convolutional layer 351 with 64 channel input with 128 features and 2 channel output with 256 features.

Each of the each of the plurality of transposed convolutional layers 350 has a kernel of size (2, 9) and a stride of size (1, 2), in one embodiment.

An output of the first convolutional layer 321 is provided as an input to the first transposed convolutional layer 351.

An output of the second convolutional layer 322 is provided as an input to the second transposed convolutional layer 352.

An output of the third convolutional layer 323 is provided as an input to the third transposed convolutional layer 353.

An output of the fourth convolutional layer 324 is provided as an input to the fourth transposed convolutional layer 354.

An output of the fifth convolutional layer 325 is provided as an input to the fifth transposed convolutional layer 355.

An output of the sixth convolutional layer 326 is provided as an input to the sixth transposed convolutional layer 356.

The output of the first transposed convolutional layer 251 is added to the input of the first convolutional layer 321, and the sum is provided as an input to the ISTFT layer 370 to effect feature restoration in generating the audio output signal 55.

It is appreciated that the quantity of convolutional layers 320, the quantities of features and channels associated with the individual convolutional layers 320, the quantity of transposed convolutional layers 350, the quantities of features and channels associated with the individual transposed convolutional layers 350, the kernel sizes, and the stride sizes, the quantity, type, and size of RNN layers (330, 332), and the quantity, and size of the dense layer (340) are application-specific, and are selected based upon factors related to computational speed, processor capabilities, sound quality, etc.

Figure 4:
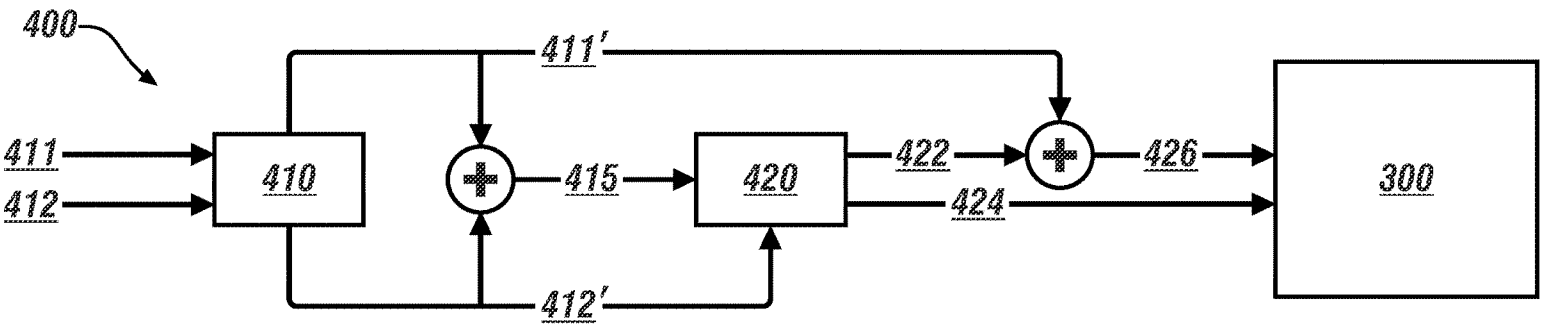
FIG. 4 schematically illustrates elements related to a training module for training a deep neural network (DNN) module to process an audio input signal, in accordance with the disclosure.

FIG. 4 schematically illustrates elements related to a training module 400 for training an embodiment of the deep neural network (DNN) module of the feature restoration algorithm 300 described with reference to FIG. 3 to process an audio input signal 15. Inputs to the training module 400 include an audio input signal in the form of clean speech 411 and an audio input signal in the form of noise 412, e.g., white noise, road noise, babble noise etc., both of which are provided in an amplitude domain. The clean speech 411 and noise 412 are input to a STFT layer 410, which converts them to the frequency domain, as transformed clean speech 411' and transformed noise 412'.

The transformed clean speech 411' and transformed noise 412' are added to form noisy speech 415. The noisy speech 415 and the transformed noise 412' are input to NLP 420, which enhances the noise reduction level by employing non-linear filtering to attenuate the noise level. Outputs of the NLP 420 include a residual noise 422 and a combination of distorted speech and the residual noise 424. The residual noise 422 is added to the transposed clean speech 411' to form a first input 426. The first input 426 in the form of residual noise 422 added to the transformed clean speech 411', and the combination of the distorted speech and the residual noise 424 are provided as inputs to the feature restoration algorithm 300 described with reference to FIG. 3 to effect training.

This arrangement of the inputs to the training module 400 acts to train the feature restoration algorithm 300 to restore the speech missing features without affecting the noise levels. The residual noise signal is produced by processing the noise signal according to the noisy speech processing. The deep learning approach described herein unifies the feature extraction process through several layers of neural network. During the training process, the parameters of the neural network will be learned, and then in real time the real time sound is fed into the trained neural network to achieve speech feature restoration.

The concepts described herein provide a system that employs a speech feature restoration module in place of a perfectly tuned PF. The Feature Restoration module will oversee restoring the original speech quality, which allows for both better noise reduction and voice quality that otherwise cannot be reached by known approaches. In the case of a perfect restoration, the PF can be configured to output the desired noise level regardless of the added desired speech distortion.

Embodiments in accordance with the present disclosure may be embodied as an apparatus, method, or computer program product. Accordingly, the present disclosure may take the form of an entirely hardware embodiment, an entirely software embodiment (including firmware, resident software, micro-code, etc.), or an embodiment combining software and hardware aspects that may generally be referred to herein as a "module" or "system." Furthermore, the present disclosure may take the form of a computer program product embodied in a tangible medium of expression having computer-usable program code embodied in the medium.

The flowchart and block diagrams in the flow diagrams illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by dedicated-function hardware-based systems that perform the specified functions or acts, or combinations of dedicated-function hardware and computer instructions. These computer program instructions may also be stored in a computer-readable medium that can direct a computer or other programmable data processing apparatus to function in a particular manner, such that the instructions stored in the computer-readable medium produce an article of manufacture including instruction set that implements the function/act specified in the flowchart and/or block diagram block or blocks.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the claims.

What is claimed is:

1. A system for processing an audio input signal, the system comprising:

a microphone, a controller, data storage, and a communication link to a remotely located audio speaker;

wherein the microphone is configured to capture and generate the audio input signal and communicate the audio input signal to the controller;

wherein the controller is operatively connected to the communication link; and wherein the data storage includes instructions that are executable by the controller, the instructions including:

generate, via a linear noise reduction filtering algorithm, a first resultant based upon the audio input signal;

generate, via non-linear post filtering algorithm, a second resultant based upon the first resultant;

generate, via a feature restoration algorithm, an audio output signal based upon the second resultant; and communicate, via the communication link, the audio output signal to the remotely located audio speaker;

wherein the feature restoration algorithm comprises a deep neural network (DNN)-based module including: a STFT (Short-time Fourier transform); a plurality of convolutional layers; a first LSTM (Long Short-Term Memory) layer; a second LSTM layer; a dense layer; a plurality of transposed convolutional layers; and an Inverse STFT (ISTFT);

wherein the plurality of convolutional layers comprises:

a first convolutional layer having a 2 channel input with 256 features and a 32 channel output with 128 features;

a second convolutional layer having a 32 channel input with 128 features and a 64 channel output with 64 features;

a third convolutional layer having a 64 channel input with 64 features and a 128 channel output with 32 features;

a fourth convolutional layer having a 128 channel input with 32 features and a 128 channel output with 16 features;

a fifth convolutional layer having a 128 channel input with 16 features and a 258 channel output with 8 features; and a sixth convolutional layer having a 256 channel input with 8 features and a 256 channel output with 4 features.

2. The system of claim 1, wherein the STFT transforms the audio input signal from an amplitude domain to a frequency domain.

3. The system of claim 2, wherein the STFT transforms the audio input signal to the frequency domain having a 2 channel sequence having a real portion and an imaginary portion.

4. The system of claim 1, wherein the 256 channel output with 4 features that is output from the sixth convolutional layer is provided as an input to the first LSTM layer.

5. The system of claim 1, wherein each of the plurality of convolutional layers has a kernel of size (2, 9) and a stride of size (1, 2).

6. The system of claim 1, wherein an output of the first convolutional layer is provided as an input to the ISTFT.

7. The system of claim 1, wherein the output of the sixth convolutional layer is provided as input to the first LSTM layer.

8. The system of claim 1, wherein the first LSTM layer has 256 states.

9. The system of claim 1, wherein the second LSTM layer has 256 states.

10. The system of claim 1, wherein the plurality of transposed convolutional layers comprises a sixth transposed convolutional layer having a 512 channel input with 4 features and 256 channel output with 8 features; a fifth transposed convolutional layer having a 512 channel input with 8 features and a 128 channel output with 16 features; a fourth transposed convolutional layer having a 256 channel input with 16 features and a 128 channel output with 32 features; a third transposed convolutional layer with a 256 channel input with 32 features and 64 channel output with 64 features; a second transposed convolutional layer with 128 channel input with 64 features and a 32 channel output with 128 features; and a first transposed convolutional layer with 64 channel input with 128 features and 2 channel output with 256 features.

11. The system of claim 10, wherein the output of the dense layer is provided as input to the sixth transposed convolutional layer.

12. The system of claim 10, wherein each of the plurality of transposed convolutional layers has a kernel of size (2, 9) and a stride of size (1, 2).

13. The system of claim 10, wherein the output of the first transposed convolutional layer is provided as an input to the ISTFT to effect feature restoration.

14. The system of claim 13, wherein the ISTFT transforms the audio input signal transposed to a frequency domain in combination with the output of the first transposed convolutional layer from the frequency domain to an amplitude domain to generate the audio output signal.

15. A method for processing an audio input signal, the method comprising:

capturing, via a microphone, an audio input signal;

subjecting the audio input signal to a linear noise reduction filtering algorithm to generate a first resultant;

subjecting the first resultant to a non-linear post filtering algorithm to generate a second resultant;

generating an audio output signal by subjecting the second resultant to a feature restoration algorithm; and controlling a speaker responsive to the audio output signal;

wherein the feature restoration algorithm comprises a deep neural network (DNN)-based module including: a STFT (Short-time Fourier transform); a plurality of convolutional layers; a first LSTM (Long Short-Term Memory) layer; a second LSTM layer; a dense layer; a plurality of transposed convolutional layers; and an Inverse STFT (ISTFT);

wherein the plurality of convolutional layers comprises:

a first convolutional layer having a 2 channel input with 256 features and a 32 channel output with 128 features;

a second convolutional layer having a 32 channel input with 128 features and a 64 channel output with 64 features;

a third convolutional layer having a 64 channel input with 64 features and a 128 channel output with 32 features;

a fourth convolutional layer having a 128 channel input with 32 features and a 128 channel output with 16 features;

a fifth convolutional layer having a 128 channel input with 16 features and a 258 channel output with 8 features; and a sixth convolutional layer having a 256 channel input with 8 features and a 256 channel output with 4 features.

16. A system for processing speech input, the system comprising:

a microphone, a controller, and a speaker;

wherein the microphone is configured to capture a speech input signal and communicate the speech input signal to the controller; and wherein the controller is operatively connected to the speaker;

wherein the controller includes executable code to:

subject the speech input signal to a linear noise reduction filtering algorithm to generate a first resultant;

subject the first resultant to a non-linear post filtering algorithm to generate a second resultant;

generate a speech output signal by subjecting the second resultant to a feature restoration algorithm; and control the speaker responsive to the speech output signal;

wherein the feature restoration algorithm comprises a deep neural network (DNN)-based module including: a STFT (Short-time Fourier transform); a plurality of convolutional layers; a first LSTM (Long Short-Term Memory) layer; a second LSTM layer; a dense layer; a plurality of transposed convolutional layers; and an Inverse STFT (ISTFT);

wherein the plurality of convolutional layers comprises:

a first convolutional layer having a 2 channel input with 256 features and a 32 channel output with 128 features;

a second convolutional layer having a 32 channel input with 128 features and a 64 channel output with 64 features;

a third convolutional layer having a 64 channel input with 64 features and a 128 channel output with 32 features;

a fourth convolutional layer having a 128 channel input with 32 features and a 128 channel output with 16 features;

a fifth convolutional layer having a 128 channel input with 16 features and a 258 channel output with 8 features; and a sixth convolutional layer having a 256 channel input with 8 features and a 256 channel output with 4 features.

17. The system of claim 16, wherein the STFT transforms the audio input signal from an amplitude domain to a frequency domain.

18. The system of claim 17, wherein the STFT transforms the audio input signal to the frequency domain having a 2 channel sequence having a real portion and an imaginary portion.

19. The system of claim 16, wherein the 256 channel output with 4 features that is output from the sixth convolutional layer is provided as an input to the first LSTM layer.

20. The system of claim 16, wherein an output of the first convolutional layer is provided as an input to the ISTFT, and wherein the output of the sixth convolutional layer is provided as input to the first LSTM layer.

* * * * *